US005271973A

United States Patent [19]

Huether

[11] Patent Number: 5,271,973

[45] Date of Patent: Dec. 21, 1993

[54] ARCHITECTURAL GLASS PANEL

[76] Inventor: Gordon A. Huether, 101 S. Coombs St., #D, Napa, Calif. 94559

[21] Appl. No.: 955,559

[22] Filed: Oct. 1, 1992

[51] Int. Cl.[5] ..... E06B 3/24; A47G 35/00

[52] U.S. Cl. ..... 428/34; 428/13; 428/212; 428/542.2; 428/913; 52/788

[58] Field of Search ..... 428/34, 542.2, 13, 14, 428/192, 45, 46, 212, 187, 426, 913, 167; 52/788-790; 156/107, 109

[56] References Cited

U.S. PATENT DOCUMENTS 4,791,010 12/1988 Hanley ..... 428/34

4,975,307 12/1990 Sollogoub ..... 428/34

*Primary Examiner*—Donald J. Loney

*Attorney, Agent, or Firm*—Claude A. S. Hamrick

[57] ABSTRACT

A decorative glass panel comprising two outer panes of transparent or translucent glass and at least one transparent or translucent inner pane having at least one blown glass piece disposed thereon. The portions of the inner surfaces of the outer panes may be etched to facilitate light diffusion, leaving non-etched aperture portions that are similarly shaped and in exact alignment with the blown glass piece.

10 Claims, 5 Drawing Sheets

ARCHITECTURAL GLASS PANEL

BACKGROUND OF THE INVENTION

1. Field of the Invention

This invention relates generally to decorative glass products, and more particularly to a multi-layered commercial glass panel where colored, blown-glass shapes are affixed to an inner layer of glass to form a decorative glass panel.

2. Brief Description of the Prior Art

Double-paned windows and other types of multi-layered, insulating glass panels are common in the prior art. The Basic Insulating Glass Manual, produced by C. R. Laurence Co., Inc., describes the steps in fabrication of double or triple-paned, sealed, insulating glass units.

An insulated glass panel is comprised of two sheets of glass, separated by a spacer disposed between the sheets of glass proximate the edges thereof. The edges of the panel are sealed, typically with a silicone sealant, to retard moisture penetration and to maintain a structural bond between the two sheets of glass. The entrapped air within the panel is normally at atmospheric pressure. A moisture adsorption (desiccant) material is disposed within the panel to remove moisture from the entrapped air between the glass.

Viracon, Inc., in its 8820/VIR brochure, describes a two-paned architectural glass product that includes a translucent colored or graphically imprinted interlayer sandwiched between the two panes of glass. The interlayer is affixed directly to each pane of glass, allowing no space therebetween.

SUMMARY OF THE INVENTION

It is therefore a primary objective of the present invention to provide a multi-paned, insulated glass panel including at least one decorative inner layer of commercial glass having pieces of blown glass laminated thereto.

Another objective of the present invention is to provide a decorative insulated glass panel having outer panes of commercial high performance glass that match or contrast with adjacent building materials.

A further objective of the present invention is to provide a decorative insulated glass panel having etched portions and clean portions disposed in a spaced apart relationship to colored glass shapes, whereby decorative colored designs are cast by light passing through the panel, where portions of the inner surfaces of the outer panes are etched to diffuse light.

Briefly, a preferred embodiment of the present invention includes an insulated glass panel comprising two outer panes of transparent or translucent glass and at least one transparent or translucent inner pane having at least one blown glass piece disposed thereon. The portions of the inner surfaces of the outer panes may be etched to facilitate light diffusion, leaving non-etched aperture portions that are similarly shaped and in alignment with the blown glass piece.

An important advantage of the present invention is that it provides a multi-paned, insulated glass panel including a decorative inner layer of pieces of blown glass laminated to a pane of commercial glass.

Another advantage of the present invention is that it provides a decorative insulated glass panel having outer panes of commercial high performance glass that match or contrast with adjacent building materials.

A further advantage of the present invention is that it provides a decorative insulated glass panel having etched portions and clean portions disposed in a spaced apart relationship to colored glass shapes, whereby decorative colored designs are cast by light passing through the panel, where portions of the inner surfaces of the outer panes are etched to diffuse light.

These and other objects and advantages of the present invention will no doubt become apparent to those skilled in the art after having read the following detailed description of the preferred embodiment which is illustrated by the various drawing figures.

DETAILED DESCRIPTION OF THE PREFERRED EMBODIMENT

Figure 1:
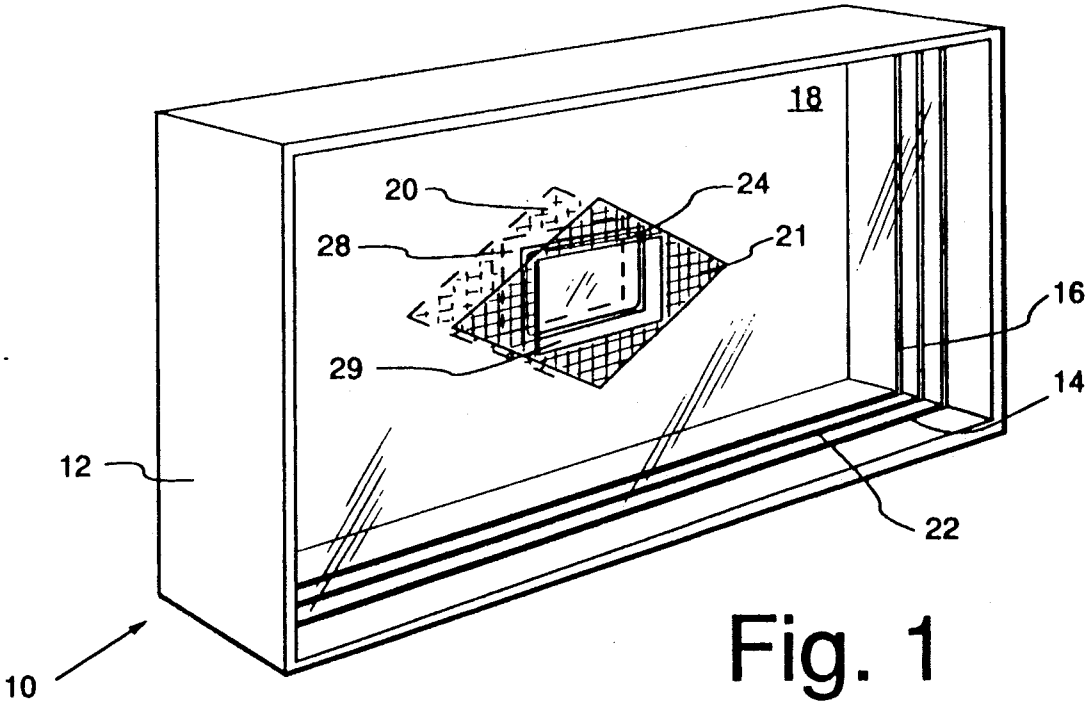
FIG. 1 is a perspective view of a decorative glass panel in accordance with the present invention, showing a tri-paned panel having two etched outer panes and one inner pane including a piece of blown glass attached thereon.

FIG. 1 is a perspective view of a decorative glass panel in accordance with the present invention. The panel 10 is comprised of a generally rectangular sash 12 that frames three panes of glass, comprising a first outer pane 14, a second outer pane 16 and a central pane 22. The first outer pane 14 and the second outer pane 16 are comprised of a commercial high performance glass that may either match or contrast with adjacent building materials. It is anticipated that other types of glass may be selected by the architect, such as bronze glass or Solex TM glass.

The first outer pane 14 and the second outer pane 16 further include transparent portions 18 and 19, respectively, and etched portions 20 and 21, respectively. The central pane 22 is a transparent or translucent pane of glass having at least one relatively small piece of glass 24 affixed thereto. The glass piece 24 can be any shape, and the rectangular piece illustrated in this figure is by way of example only. It is anticipated that any other positioning of the glass upon the central pane 22, such as offset from the center of the pane, may be used as well. The glass piece 24 can be of any color, including non-solid colors. It is also anticipated that blown glass and multiple pieces of blown glass may be used, and a decorative design, pattern or portrait may be created out of differently colored blown glass pieces.

Those skilled in the art will recognize that blown glass is only one type of glass that can be used with the center pane. Other types include stained glass, beveled glass, dichroic glass or any other type of colored or stained glass, and the appended claims are to be interpreted to cover all such types of glass.

The glass piece 24 can be affixed to either side of the central pane 22 by any adhesive having optical clarity, non-cracking and non-yellowing properties. Common adhesives that are practical for this purpose are optically clear silicone adhesives, such as those made by General Electric or Dow Chemical.

Figure 2:
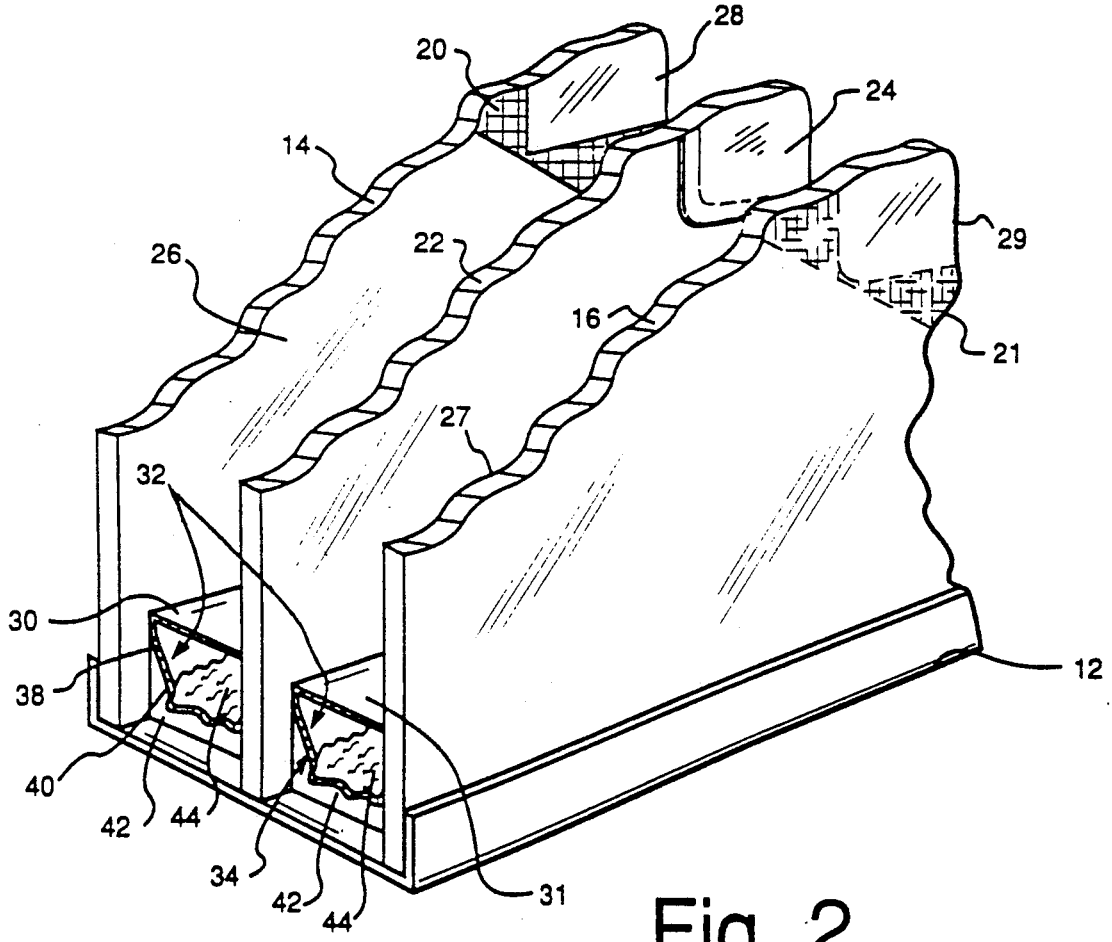
FIG. 2 is a perspective view of a broken portion of the panel of FIG. 1, showing the spacers disposed between each pane.

In the preferred embodiment, the etched portions 20 and 21 are formed on inner surfaces 26 and 27 respectively, of the outer panes 14 and 16, as is best seen in FIG. 2. For achieving a favorable visual effect, one or both of the etched portions 20 and 21 may include cross-hatched liens cut into the inner surfaces 26 and 27. Additionally, the etched portions 20 and 21 need not be limited to the center of the pane 14 and 16 as shown, and may extend the full breadth and width of the pane. The etching of the glass is accomplished in the preferred embodiment by sand blasting, but may also be achieved by fluoric acid etch. As an alternative, a frosting or other typwe of engraving could be substituted for the etching.

The etched portions 20 and 21 preferably include non-etched sections 28 and 29 that are centrally located within the etched portions. The sections 28 and 29 are designed to imitate the shape of the blown glass piece 24, in order to radiate onto an adjacent surface an unobstructed image of the color(s) and shape of the blow glass 24, as light passes through the panel 10.

FIG. 2 is a perspective view of a broken edge portion of the panel of FIG. 1, showing two standard single shouldered spacers 30 and 31 disposed between the two outer panes 14 and 16 and the central pane 22, where the spaced panes are framed by a sash 12. Each spacer 30 and 31 is generally rectangular in cross section and includes a hollow centrally disposed cavity 32. Each spacer 30 and 31 further include side member 34 having a shoulder portion 38 and an indented fill portion 40 upon which a sealant 42 is placed.

The sealant 42 used in the preferred embodiment is a silicone sealant, however other types of sealants, such as polysulfide, urethane and hot melt butyl, may be used as well. Silicone sealants are available in one-part to two-part systems; both including a primary seal of polyisobutylene and a secondary seal of silicone. A one-part silicone system includes a non-flowing silicone elastomer that does not require the addition of plasticizing agents or catalysts to achieve optimum properties. The two-part silicones are non-flowing with a silicone rubber-based compound and activator.

Silicone sealants are generally preferred because they possess excellent resistance to ultraviolet radiation, climatic variations, resistance to ozone, and have excellent adhesion to glass and aluminum. On the whole, silicon sealants are unaffected by cold and heat and are compatible with most any bedding compound. Butyl bedding compounds are used when glazing the insulating glass unit to the sash.

A moisture adsorbent (or desiccant) material 44 is disposed within the hollow cavity 32 of the spacers 30 and 31. In the preferred embodiment, the adsorbent 44 is comprised of molecular sieve, which has the greatest capacity for adsorbing water and chemical vapors. Blends, such as molecular sieve and silica gel, may also be used and it is anticipated that many other types of adsorbents known to those skilled in the art may also be used.

Figure 3A:
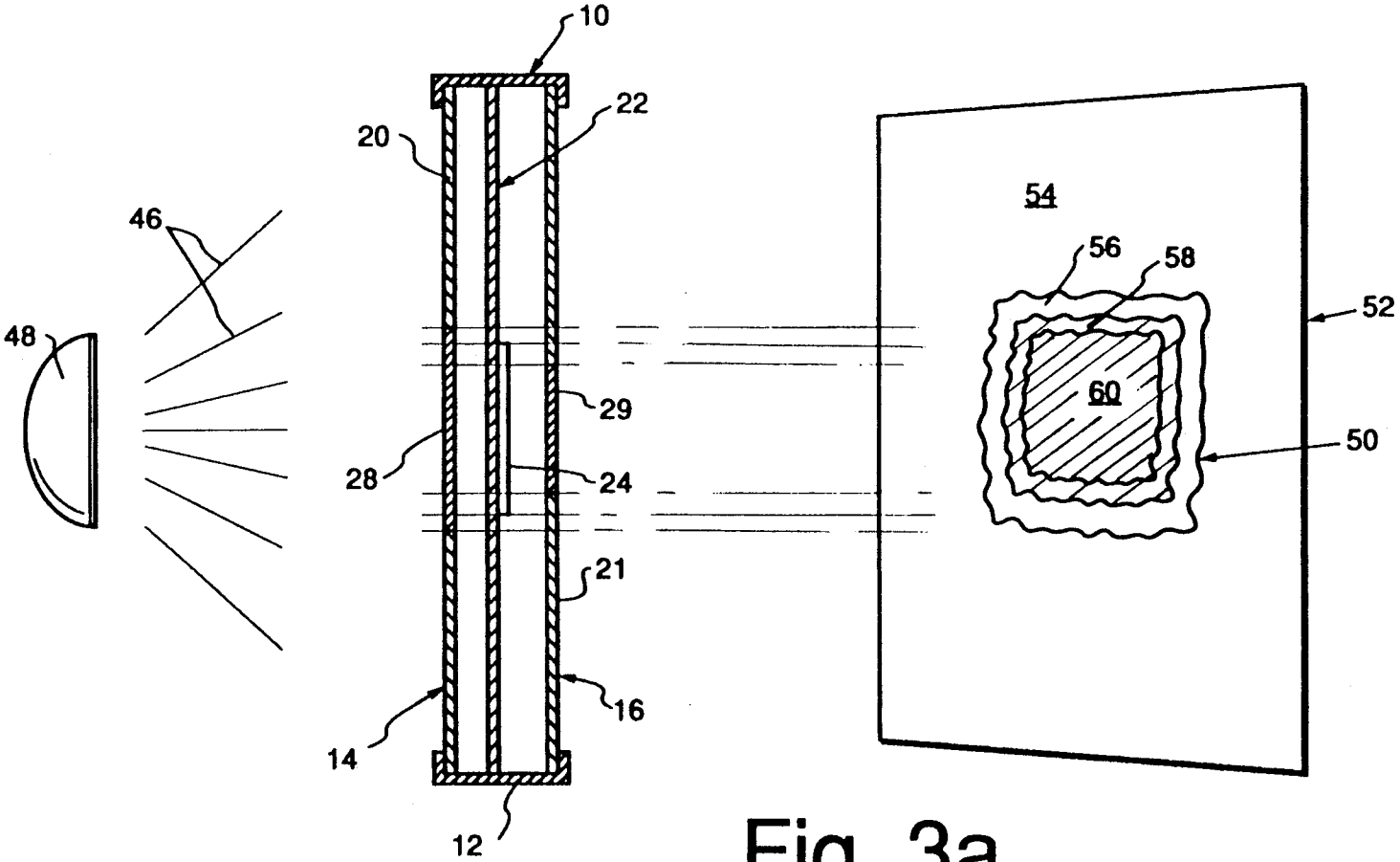
FIG. 3*a* is a side view of a decorative glass panel, through which light rays from a source are diffused by etched lines in the glass and refracted due to the different density of the blown glass, where the rays are cast onto an adjacent surface.

FIG. 3*a* is a side view of a decorative glass panel 10 in accordance with the present invention, showing how light rays 46 projected from a light source 48 positioned generally perpendicularly to the panel 10 are affected as they pass through the panel 10, and how an image 50 of overlapping shapes is created on an adjacent surface 52. Some of the rays 46 radiating from the light 48 pass directly through the relatively large transparent section 28 in the first outer pane 14, while the rest are caught and diffused by the etched portion 20 thereon. As the rays 46 pass through the transparent central pane 22 and the piece of blown glass 24 affixed thereto, the different density of, and irregularities in the blown glass cause the portion of the rays 46 that pass therethrough to refract. Upon passing through the second outer pane 16, some of the rays 46 are again diffused by the etched portion 21 thereon, while the others pass directly through the smaller transparent section 27 before they all finally shine on an adjacent surface 52, such as a wall or screen. The image 50 cast on the surface 52 is comprised of a plurality of overlapping sections, each section having a different intensity or color of illumination. For example, we will consider the light source 48 to be a white light and the piece of blown glass 24 to be red in color.

The first illuminated section 54 is the least bright, as the white light rays have been twice diffused by passing through the etched portion 20 of the first outer pane 14 and the etched portion 21 of the second outer pane 16.

The second illuminated section 56, although still white in color, is brighter than the first illuminated section 54 as the rays have passed through the transparent (or non-etched) section 28 of the first outer pane 14, the transparent central pane 22 and the etched portion 21 of the second outer pane 16. This light is diffused only once, thus enhancing its brightness.

The third illuminated section 58 has the same intensity as the second illuminated section 56, as the light rays have passed through only one etched pane, but the color of this section is red. The light rays 46 comprising the third illuminated section 58 have passed through the transparent section 28 of the first outer pane 14, the transparent central pane 22, the piece of red-colored blown glass 24 laminated to the central pane 22 (picking up the color), and the etched portion 21 of the second outer pane 16.

The fourth illuminated section 60 is the brightest section as none of the rays comprising this section has been diffused by passing through etched glass. The light rays 46 comprising the fourth illuminated section 60 are red as they have passed through the transparent section 28 of the first outer pane, the transparent central pane 22, the piece of red-colored blown glass 24, and the transparent section 29 of the second outer pane 16.

Figure 3B:
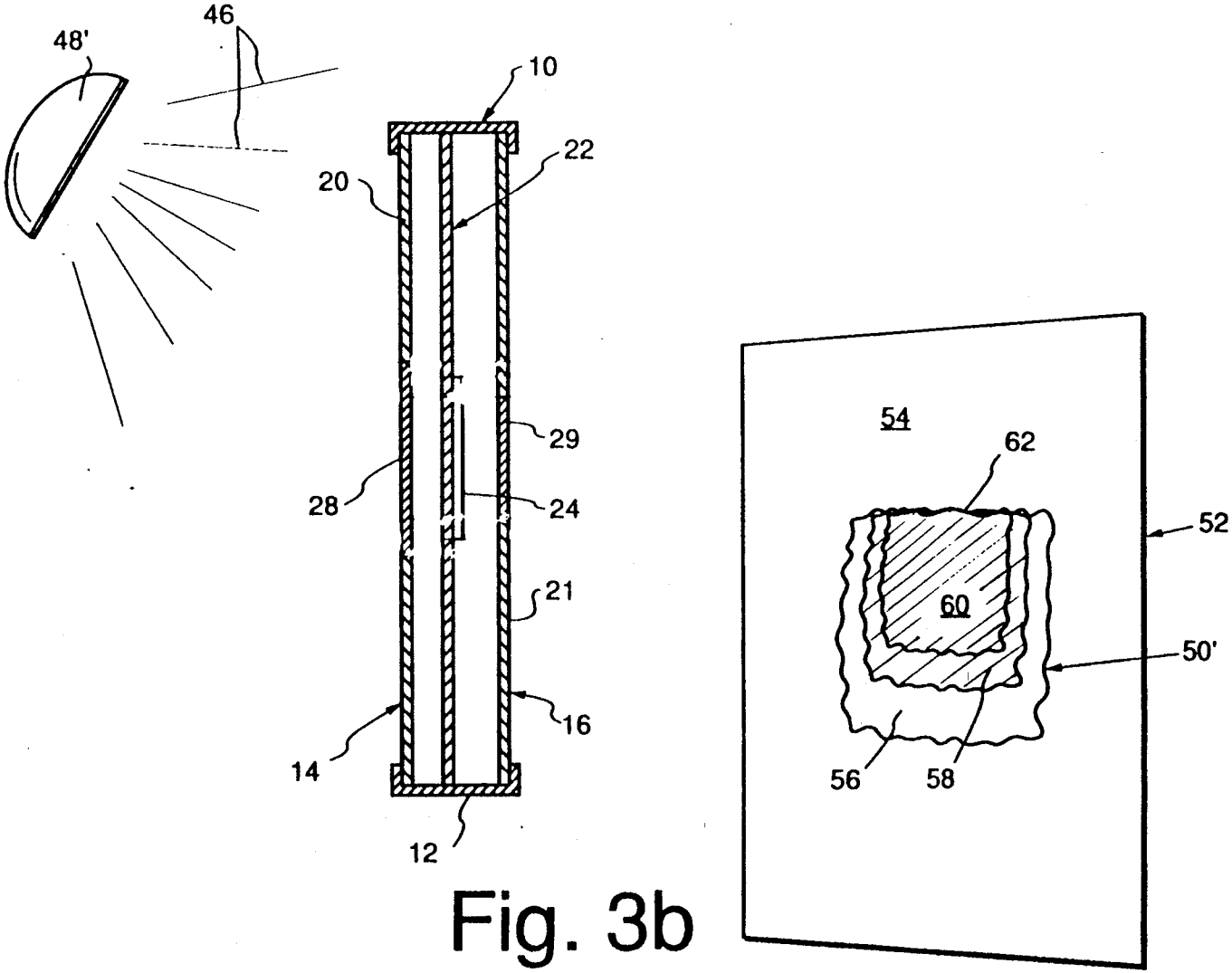
FIG. 3*b* shows the panel of FIG. 3*a* where the positioning of the light source is changed, and further shows the concomitant effect on the image cast onto the adjacent surface.

FIG. 3*b* shows how changing the angle of the light source affects the image cast onto the adjacent surface. The panel 10 shown in this figure is the same as that shown in FIG. 3*a*, however, instead of projecting light rays 46 perpendicularly to the panel 10, the light source 48' is positioned at an angle thereto. The resulting image 50' that is cast upon the surface 52 is that of four differently illuminated sections that are eccentrically disposed, with the second illuminated section 56, third illuminated section 58 and fourth illuminated section 60 sharing a common border 62, due to the positioning of the light source 48'. Likewise, changing the angle of the surface 52 relative to the positioning of the panel 10 will similarly affect the image 50' the light rays 46 cast thereon.

Figure 4:
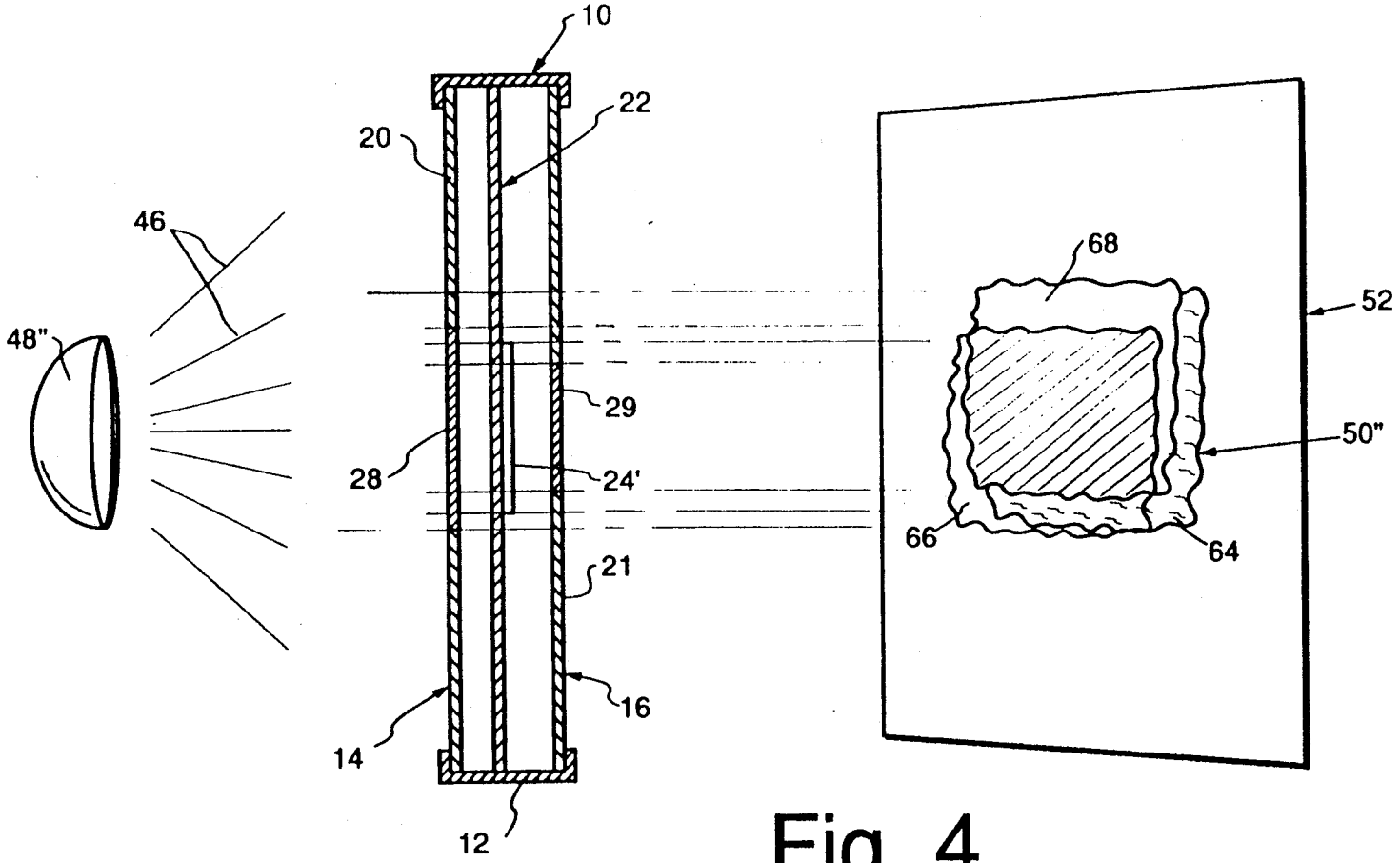
FIG. 4 is an alternative embodiment of the panel shown in FIG. 3*a*, showing a different relationship between the position of the transparent apertures in the outer panes and the position of the blown glass, and further shows the concomitant effect on the image cast onto the adjacent surface.

FIG. 4 is an alternative embodiment of the panel shown in FIG. 3*a*, illustrating a different positioning of the blown glass 24' with respect to the transparent sections 28 and 29 on the outer panes 14 and 16 respectively, and the concomitant effect of the changed positioning on the image 50" cast onto the adjacent surface 52. The transparent section 28 on the first outer pane 14 is perfectly aligned with transparent section 29 on the second outer pane 16, but the positioning of the blown glass 24' attached to the central pane 22 is offset from that of the sections 28 and 29. Further, the light source 48" is positioned at an angle to the panel 10.

As in the previous embodiment, some the rays 46 radiating from the light 48" pass directly through the transparent section 28 in the first outer pane 14, the others are diffused by the etched portion 20 thereon. As the rays 46 pass through the central pane 22, those that pass through the blown glass 24' are refracted, while the rest pass directly through the transparent central pane 22. Upon passing through the second outer pane 16, some of the rays 46 are again diffused by the etched portion 21 thereon, and other pass directly through the smaller transparent section 27 before all finally shine on the adjacent surface 52.

The image 50" shown in this figure reflects the change in position of the blow glass 24' with respect to the sections 28 and 29, and the change in angle of the light source 48". The angle of the light 48" causes the cast 64 of the transparent section 29 of the second outer pane 16, constituting illuminated section 64, to fall to one side of the cast 66 of the transparent section 28 of the first outer pane 14, constituting illuminated section 66. Further, the raised position of the blown glass piece 24' causes the red-colored portion of the image, constituting illuminated section 68, to be cast onto the surface 52 above the other illuminated sections 64 and 66.

Although the present invention has been described above in terms of a specific embodiment, it is anticipated that alternations and modifications thereof will no doubt become apparent to those skilled in the art. It is therefore intended that the following claims be interpreted as covering all such alterations and modifications as fall within the true spirit and scope of the invention.

What is claimed is:

1. A decorative glass panel comprising:

at least one first glass pane having an outer surface and an inner surface, the inner surface of said first pane being translucent in a first area and clear in a second area bounded by said first area;

a second pane having an outer surface and an inner surface, said inner surface of said second pane being disposed in a spaced apart relationship to said first pane;

said first and second panes being disposed in parallel relationship, and hermetically sealed together around their perimeter; and a geometrically shaped object fixedly engaged to said second pane and generally aligned with said second area such that light from a source on one side entering said panel will cause images of said second area and said object to be projected from the other side of said panel, said images being misaligned relative to each other as a function of the angle of incidence of the entering light.

2. A decorative glass panel as described in claim 1 wherein said geometrically shaped object includes at least one piece of glass having light transmitting characteristics different from those of said first and second glass panes.

3. A decorative glass panel as described in claim 2 wherein said piece of glass is blow glass.

4. A decorative glass panel as described in claim 2 wherein said piece of glass is colored glass.

5. A decorative glass panel as described in claim 2 wherein said piece of glass is selected from the group consisting of stained glass, beveled glass and dichroic glass.

6. A decorative glass panel comprising:

first outer glass pane having an outer surface and an inner surface, the inner surface of said first pane being translucent in a first area and clear in a second area bounded by said first area;

at least one central glass pane disposed in a spaced apart relationship to said inner surface of said first outer pane;

a second outer pane having an outer surface and an inner surface, said inner surface of said second outer pane being disposed in a spaced apart relationship to said central pane and being translucent in a third area and clear in a fourth area bounded by said third area, said second and fourth areas being in general alignment with each other;

said first, second and central panes being disposed in parallel relationship and hermetically sealed together around their perimeter; and a geometrically shaped object fixedly engaged to said central pane and generally aligned with said second and fourth areas such that light from a source on one side entering said panel will cause images of said second area, said fourth area and said object to be projected from the other side of said panel, said images being misaligned relative to each other as a function of the angle of incidence of the entering light.

7. A decorative glass panel as described in claim 6 wherein said geometrically shaped object includes at least one piece of glass having light transmitting characteristics different from those of said outer glass panes.

8. A decorative glass panel as described in claim 7 wherein said piece of glass is blown glass.

9. A decorative glass panel as described in claim 7 wherein said piece of glass is colored glass.

10. A decorative glass panel as described in claim 7 wherein said piece of glass is selected from the group consisting of stained glass, beveled glass and dichroic glass.

* * * * *